United States Patent [19]

Strehlow

[11] Patent Number: 4,951,261

[45] Date of Patent: Aug. 21, 1990

[54] DRIVE AND SUPPORT FOR MIXER DRUM

[75] Inventor: Robert W. Strehlow, New Berlin, Wis.

[73] Assignee: McNeilus Truck and Manufacturing, Inc., Dodge Center, Minn.

[21] Appl. No.: 483,176

[22] Filed: Feb. 22, 1990

[51] Int. Cl.[5] ..... B28C 7/16; B28C 5/20

[52] U.S. Cl. ..... 366/45; 74/421 R; 74/421 A; 366/65; 366/185; 366/187

[58] Field of Search ..... 366/45, 47, 54, 55, 366/56, 57, 58, 59, 60, 61, 62, 63, 220, 185, 187, 222, 228, 233; 74/421 R, 421 A

[56] References Cited

U.S. PATENT DOCUMENTS

| | | | |
|---|---|---|---|
| 2,801,085 | 7/1957 | Maxon | 366/45 |
| 3,021,122 | 2/1962 | Maxon | 366/45 |
| 3,241,821 | 3/1966 | Maxon | 366/45 |
| 4,429,586 | 2/1984 | Dopfer | 74/421 R |

*Primary Examiner*—Robert W. Jenkins

*Attorney, Agent, or Firm*—Haugen and Nikolai

[57] ABSTRACT

Certain improvements are provided to the mechanical aspects of a tilt mixer which include a novel boggy, adjustable roller arrangement on the drum track which produces an improved distribution of the stresses produced by the extremely heavy rotating drum which reduces the wear on both individual rollers and on the track. An unique dual staggered-tooth gear drive is provided having two spaced sets of teeth each addressed by a pair of motor shaft mounted drive gears on each of a pair of flanking motors in which the teeth of the two sets are staggered or offset by one-half of the gear pitch. This produces a tighter, quieter drive which has been found to reduce gear wear. In addition, a unique torque tube system which possess a great deal more strength than previous drum tilt axles is provided to support the pivotal action of the drum thereby enabling the tilt point of the drum to be moved forward toward the discharge end of the mixers. This, in turn, reduces the amount of clearance height necessary beneath the drum upon discharge of the drum contents.

11 Claims, 3 Drawing Sheets

DRIVE AND SUPPORT FOR MIXER DRUM

CROSS REFERENCE TO RELATED APPLICATIONS

Cross reference is made to two related patent applications by the same inventor, Ser. No. 07/482,926, and Ser. No. 07/483,172, filed of even date and assigned to the same assignee as the present application. They involve separate and distinct inventions related to mixing drums for tilt mixers.

BACKGROUND OF THE INVENTION

I. Field of the Invention

The present invention generally pertains to mixing drums for batch style tilt-mixers particularly those used to mix erosive materials such as concrete prior to its being loaded into transit carriers including concrete mixer trucks, commonly known as readymix trucks. More specifically, the present invention relates to improvements in the drum drive and support design which enhance drum operation.

II. Discussion of Related Art

Tilt mixers having drums of various types have been used for many years in the construction industry for mixing batches of concrete to be loaded into trucks which, in turn, transport the concrete to job sites for placing. Over the years, experience has shown it to be most economical to manufacture tilt mixers themselves in a size capable of being transported by truck over the highways and mounted for use at the mixing plant. Therefore, they must be within the maximum size which can be legally transported on a highway. Tilt mixers are typically installed in an elevated position so that trucks hauling the pre-mixed materials may be loaded from above by tilting the mixer and discharging the mixed batch through a chute into the charging end of the truck.

Such devices typically are designed to be charged and to conduct the mixing operation in a substantially horizontal position. The charging end of the drum closely addresses a fixed loading chute for receiving measured amounts of aggregate, cement, sand and water, in the case of concrete, according to the batch formula used. The charging end of the drum must be configured so as to clear the chute when the drum is tilted to discharge the mixed materials. The, clearance with respect to the front or discharge end of the mixing drum is also important. Consideration of the height necessary to mount the drum for tilt loading of ready mix trucks and the clearance for the charging chute are important considerations which must be weighed together with the desire to make the drum itself as close as is reasonable to the ideal mixing shape, in which the length is the same as or approaches the diameter of the drum.

Most previous mixing drums of the class described have had to provide a cone with a severe angle to accommodate the charging chute and have generally been shaped with a reduced diameter with respect to length. They have also had to use a pivot point which is removed some distance from the discharge end of the drum with respect to the axis about which the drum is tilted in order to reduce the torque required to tilt the drum for discharging materials. This had led, to the development of a general drum configuration for tilt mixer drums which has become somewhat of an industry standard. It includes ends having rather radical conical sections and a rather elongated central mixing zone. The drum is mounted to be pivoted at a distance from the discharge end. The drum itself has to be mounted at a relatively high position in order for the truck loading-unloading chute beneath the discharge end of the mixer to clear the tops of the trucks which drive under the mixer for loading as the loading system must accommodate the mixing drum when fully tilted to discharge the mixed material.

In addition to the need to decrease the length to diameter ratio of the mixing drum itself, and to move the tilt axis forward to increase clearance, other aspects of the drum support and drive systems of prior mixers have certain drawbacks which have been sources of problems. First, prior drum central support rollers have consisted of a pair of single rollers riding in a track circumscribed about the drum. These two points of contact are required to support the great majority of the weight of the drum which, when loaded, may approach twenty (20) tons. These rollers frequently fail and must be replaced which causes the loss of valuable mixing time. Second, the drums, which are designed to rotate in one direction, are traditionally driven by a large ring gear having teeth adapted to be addressed by drive gears attached to the shafts of a pair of drive motors flanking the front of the mixer. These drives are typically very noisy. There must be sufficient play in the gears to accommodate slight misalignments, and starting and stopping. In present systems, this causes noise and tends to cause undue wear on the gears; and a better way to address the drive problem has been sought.

SUMMARY OF THE INVENTION

By means of the present invention, certain improvements are provided to the mechanical aspects of a tilt mixer which overcome many of the problems associated with prior art devices. The improvements include a novel boggy, adjustable roller arrangement on the drum track which produces an improved distribution of the stresses produced by the extremely heavy rotating drum which, in turn, reduces the wear on both individual rollers and on the track to produce a longer life system. An unique dual staggered-tooth gear drive is provided having two spaced sets of teeth each addressed by a pair of motor shaft mounted drive gears on each of a pair of flanking motors in which the teeth of the two sets are staggered or offset by one-half of the gear pitch. This produces a tighter, quieter drive which has been found to reduce gear wear. In addition, a unique torque tube system which possess a great deal more strength than previous drum tilt axles is provided to support the pivotal action of the drum thereby enabling the tilt point of the drum to be moved forward toward the discharge end of the mixers. This, in turn, reduces the amount of clearance height necessary beneath the drum for upon discharge of the drum contents. All the accessories directly addressing the mixing drum are mounted from the torque tube and the entire assembly pivoted with respect to the stationary support frame for the unit.

BRIEF DESCRIPTION OF THE DRAWINGS

In the drawings, wherein like numerals designate like parts throughout the same.

DESCRIPTION OF THE PREFERRED EMBODIMENT

Figure 1:
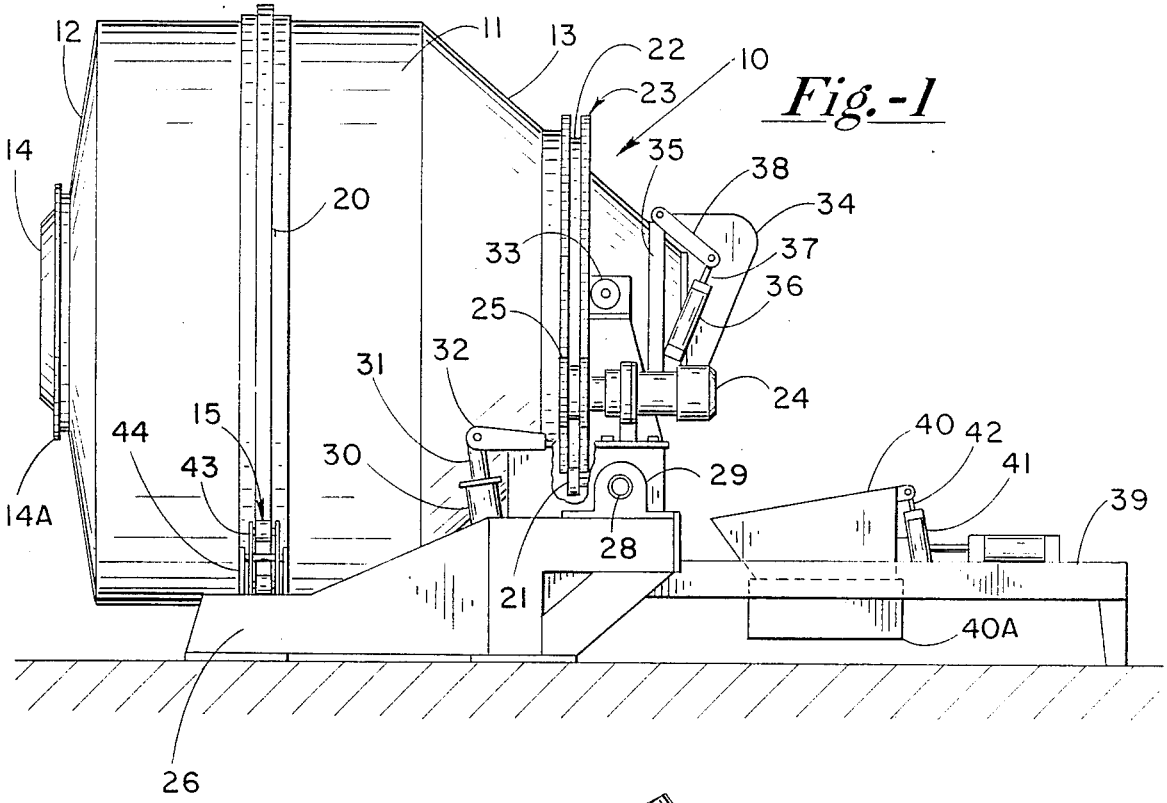
FIG. 1 is a side elevational view of a tilt mixer disposed in the horizontal and mixing position and including the improvements of the invention.

In accordance with the invention, certain improvements in the mechanisms of a tilt mixing drum are provided which dramatically increase the life expectancy of certain moving parts with respect to the rotational operation of the drum and an improved tilting system and shortened drum allows the tilt axis to be moved forward toward the discharge end of the drum. These improvements will now be described with respect to the drawing figures of a preferred embodiment which is deemed to be illustrative only demonstrating the principals of the invention but not intended to limit the scope thereof.

Figure 2:
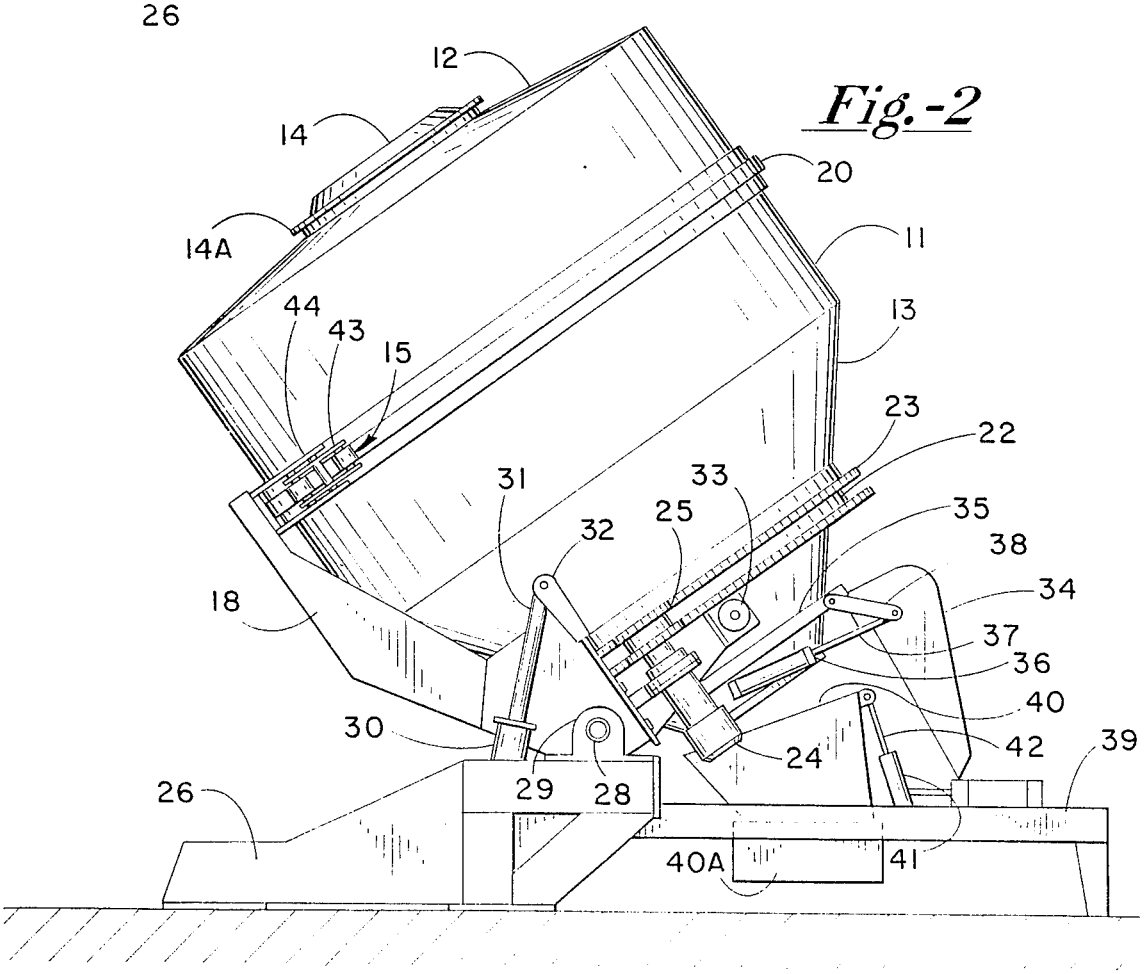
FIG. 2 illustrates the drum of FIG. 1 in a fully tilted or discharging position.
Figure 3:
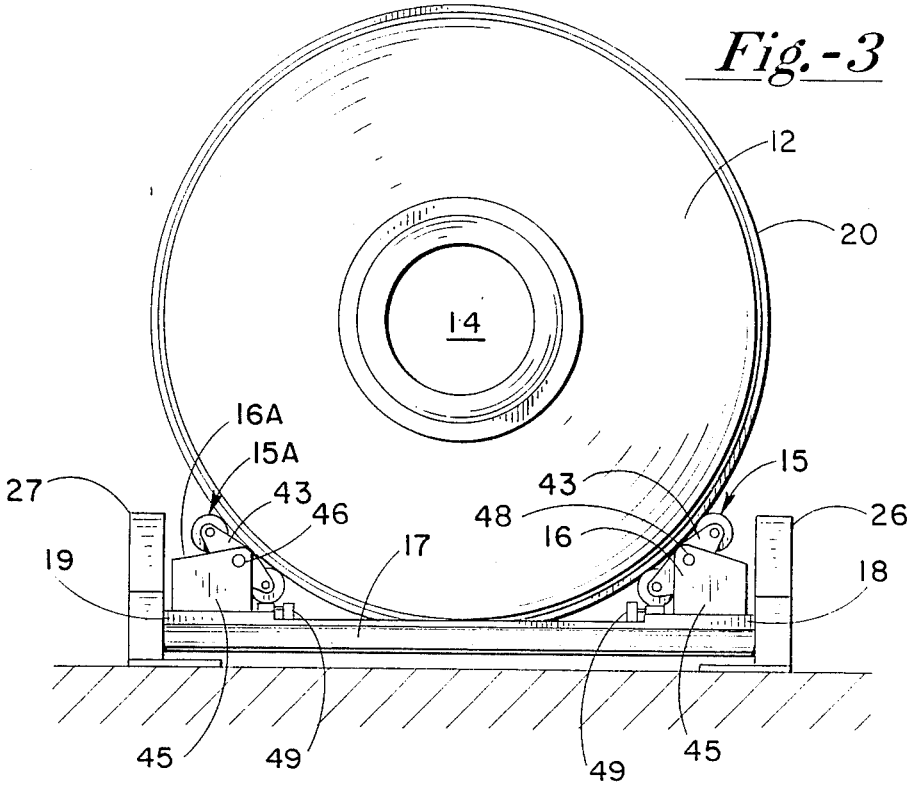
FIG. 3 is a charge end elevational view of the drum of FIG. 1 illustrating the boggy rollers.

FIGS. 1–3 illustrate a tilt mixing apparatus as it might be mounted on an elevated platform, not shown. The mixer includes a rather large diameter drum shown generally at 10 having a generally cylindrical central mixing section 11 flanked by a shallow cone rear charging section 12 and a front conical section 13. The shallow cone charging section 12 is provided with a central charge opening 14 therein for receiving the materials to be mixed. The central change opening 14 is provided with a large plastic charging seal 14A which, when removed, enlarges the opening 14 to facilitate blade replacement or other repairs inside the drum.

As best seen in FIG. 3, the rear of the drum 10 is supported for rotation about its longitudinal axis by a dual set of boggy rollers 15 and 15A each of which includes a pair of rollers or wheels 44 which are suitable journalled in rotatable fashion between a pair of parallel frame members one of which is illustrated at 45 and which, in turn, are pivotally mounted as on an axle 48 journalled through a pair of heavy mounting frame support members or flanges one pair of which is shown at 16 and the other at 16A. The heavy support members or flanges 16 and 16A are supported by a further structural member 17 which is part of a heavy reinforced tilting frame including side members 18 and 19. The supports 45 are made adjustable with respect to support member 17 as by jacks 49 so that the drum horizontal axis level can be adjusted to a true horizontal, if desired.

The boggy rollers are designed to freely pivot as necessary to ride in and follow a track or race 20 which circumscribes the generally cylindrical central mixing section 11 of the drum. The dual wheeled boggy rollers of the invention are designed to better distribute the great weight and rotational stresses associated with the heavy mixing drum 10 which has traditionally been borne by a single roller member on each side of the drum. That system, of course, was characterized by point loadings which, in turn, caused the rollers to wear at a much higher rate. The boggy rollers of the invention are designed to tolerate the slight deviations or race idiosyncracies which might be encountered throughout the circumferential travel of the drum and to spread out or distribute the load.

Figure 5:
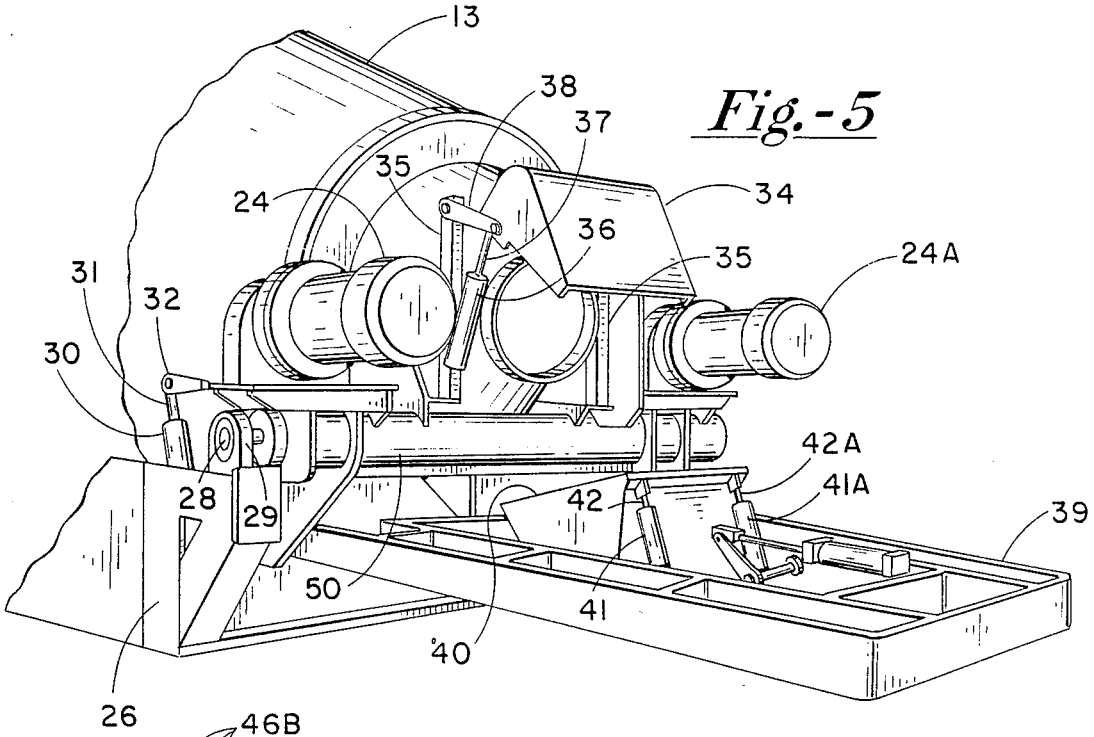
FIG. 5 is a front perspective view of a tilt mixer showing the mounting of the torque tube of the invention.
Figure 6:
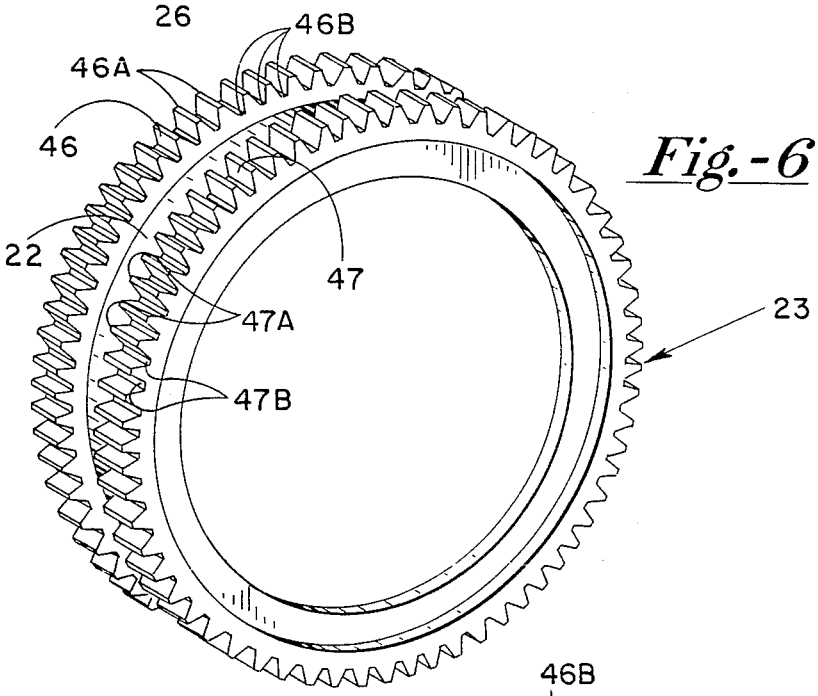
FIG. 6 is an enlarged perspective view of the ring gear of the invention.
Figure 7:
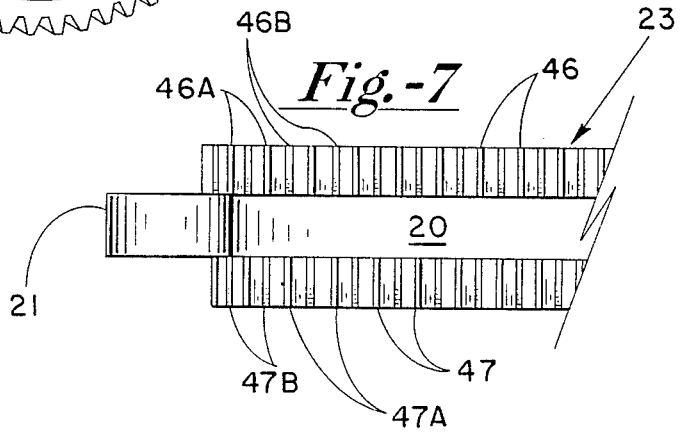
FIG. 7 is an enlarged fragmentary view of the ring gear of the invention in association with a front support roller.

Additional rollers as at 21 (FIG. 1) ride within a track or race 22 designed between the rows of teeth of the dual-tooth ring drive gear 23 which is normally bolted on toward the front of the drum. The drum is adapted to be rotated by a drive system including a pair synchronous electric motors flanking the front or cone section of the mixing drum one of which is shown at 24. The second motor appears at 24A in FIG. 5. A pair of drive gears, as at 25, are fixed or keyed to the shaft of each motor and each gear of the pair is disposed to address a corresponding row of teeth in the double-rowed ring gear 23. As best seen in FIG. 5, 6 and 7, the teeth 46 and 47 of the two adjacent parallel rows of the ring gear 23 are preferably staggered or off-set with respect to each other by approximately one-half the distance between adjacent tooth centers or one-half of the pitch of the gear. To better depict this relationship the tooth peaks or tips are further respectively designated 46A and 47A and the intertooth gaps designated 46B and 47B. This offsetting or staggering of the drive has been found to reduce the noise of drum rotation a great deal and to reduce the wear on the drive system caused by the play between the teeth of intermeshing gears which is especially effected during starting and stopping of the drum rotation. This arrangement in effect reduces the drawbacks of allowing play between intermeshing gears without lowering the advantages.

The tilting operation of the drum involves pivoting the entire drum by raising the frame on which the drum is mounted with respect to its stationary mount represented by fixed mounting base members 26 and 27 which flank the members 18 and 19. The pivot point or axis of rotation preferably resides in a relatively large diameter torque tube (illustrated at 50 in FIG. 5) which is attached to a pair of heavy flanking longitudinal axles one of which is shown at 28 which are suitably journalled into a pair of heavy bearings mounted on the stationary base members 26 and 27 as illustrated by the pillow block 29. The elevation of the drum 10 is controlled by a pair of fluid operated cylinder systems as illustrated by cylinder 30, in FIG. 2, with rod 31 which is pivotally mounted to an arm member 32 attached to supporting structural member 19 in a well-known manner. Additional support for the mixing drum 10 while disposed in an elevated state is provided by a plurality of thrust rollers mounted from the movable frame, one of which is shown at 33, which bear against the side of the ring gear thereby maintaining the position of the drum relative to the other support and drive mechanisms during tilting.

The mixing drum may be further provided with an integrally mounted dust hood 34 which is pivotally attached to a similarly shaped shroud member 35 (FIG. 5) surrounding the discharge opening of the mixing drum. The dust hood 34 is designed to be operated in cooperation with the tilting of the drum and discharging of a mixed batch by an additional fluid cylinder arrangement including cylinder 36, rod 37 and pivot arm 38 in a well-known manner. The opening of the dust hood may be controlled by a suitable electrical interlock with the tilt actuator.

The tilt mixer system further includes a discharge chute arrangement mounted on the elevated frame including a frame member 39 and may be in the form of a two-stage discharge hopper including 15 telescoped stages 40 and 40a shown fully extended and ready to receive mixed materials in FIG. 2. The telescoping discharge chute may also be cylinder operated as illustrated by cylinder 41, rod 42 and ear 43. The ability of the two-stage telescoping discharge hopper to be elevated to meet the discharge end of the mixing drum increases the allowed clearance underneath the frame by allowing the various parts attached to the mixing drum to clear the hopper at a lower level when the discharge hopper is retracted.

Figure 4:
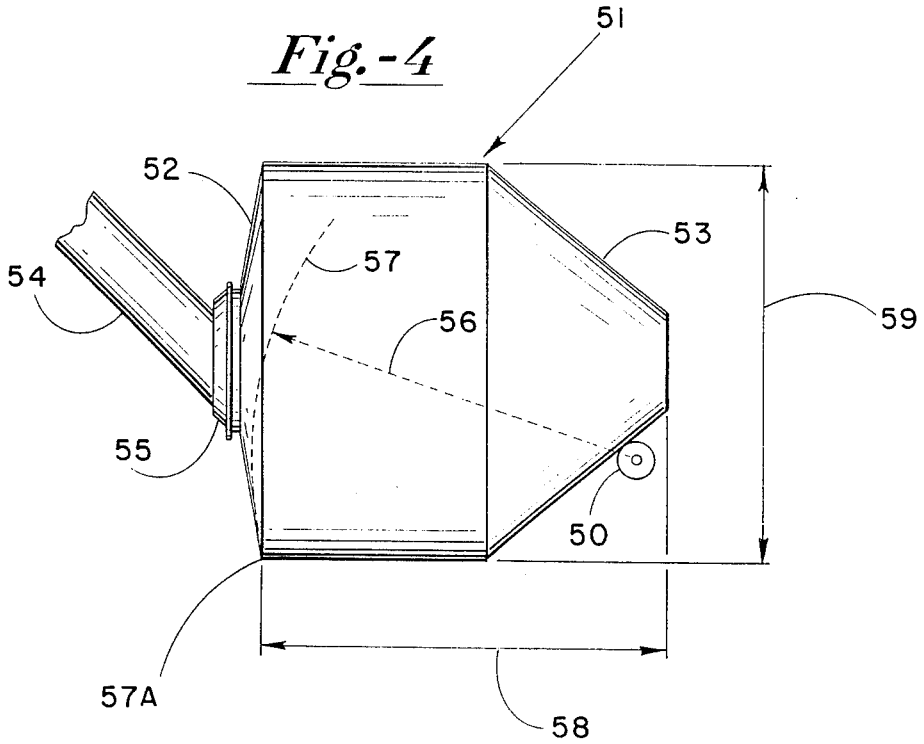
FIG. 4 is a schematic diagram of the drum illustrating certain geometric relations.

The schematic representation of the FIG. 4 is intended to illustrate the minimum cone required for operation of the drum of the invention with respect to a charge chute based on a given forward location of the pivot point or the torque tube 50. In that illustration, a mixing drum 51 including a charge section cone 52 and forward conical section 53 is shown addressing a charging chute 54 located adjacent a charging lip 55. The dashed radius 56 describing dashed arc 57 represents the minimum cone depth allowable with respect to critical corner point 57A clearing the changing chute 54 upon tilting of the drum for discharge. It will be appreciated that as the pivot point illustrated by torque tube 50 approaches the discharge end of the conical section 53 the minimum required radius 56 increases and, therefore, the minimum required depth of the cone 52, for the critical corner point 57a on the arc 57 to clear the loading chute decreases. If the point 57a is located on the arc 57, the drum 51 will just clear the charge chute at all points.

The relative length 58 and diameter 59 are also illustrated. The shortened drum length also reduces the force required to accomplish tilting of the system. Also, the relatively short charging cove and drum length moves the front-to-back center of gravity further toward the front or discharge end of the drum to further reduce the necessary title force.

It will be appreciated with regard to the tilting of the mixer system that the use of the relatively large diameter, hollow torque tube 50 permits a much heavier loading than a conventional smaller diameter solid axle with respect to both carrying the weight of all of the mechanisms attached to the tilting mixer and from the standpoint of being able to withstand the additional torque associated with the longer lever arm produced by moving the tilt point or tilt axis of the mixer further forward toward the discharge end of the cone section 13. The ideal tilt point, of course, is one which is as close to the discharge end as is possible to mechanically implement on a practical basis. The forces on the tilting axle increase a great deal as the tilt point or tilt axis is moved toward the discharge end of the conical section 13 and without the great deal of additional strength imparted to the entire tilt frame by the torque tube, which joins the two sides of the tilting frame, it would not be possible to move the tilt axis forward nearly as far as is made possible with the present invention. In addition, the torque tube can be made the principal mounting element for all of the appurtenances attached to the mixer including the thrust rollers, dust hood and other auxiliary mechanisms which are integral part of the drum of the tilt mixing system.

What is claimed is:

1. An improved drive for a tiltable rotating mixing drum for mixing concrete batch materials or the like comprising:

a rotatable mixing drum comprising a relatively flat rear conical charging zone having a central opening for receiving materials to be mixed from a charging chute, a front conical zone having a central discharge opening therein for discharging mixed materials and a generally cylindrical central zone disposed between said front and said rear conical zones;

support means for supporting said mixing drum for rotation about its longitudinal axis; drum drive means for causing and controlling the rotation of the drum about its longitudinal axis; and tilting means for causing said drum to pivot from the horizontal mixing position to a discharge position, said tilting means further comprising rotating torque tube support means providing the pivot axis and support for the drum during the pivoting function.

2. The apparatus of claim 1 wherein said drum support means further comprises a pair of boggy rollers disposed beneath the generally cylindrical central zone of said mixing drum, wherein each of said boggy rollers comprises a pair of rollers suitably journalled in rotatable fashion to thereby distribute the weight of said drum, said drum further being provided with a circumferential race in which said boggy rollers are adapted to ride during the rotation of said drum.

3. The apparatus of claim 2 wherein the rollers of each pair in each of the boggy rollers is mounted between a pair of frame members which, in turn, are pivotably mounted on a support means.

4. The apparatus of claim 3 wherein each pair of frame members is vertically adjustable so that the horizontal axis of said drum can be leveled.

5. The apparatus of claim 2 wherein said drum support means further comprises a pair of additional support rollers flanking said conical section of the drum and adapted to ride in a race defined between said two rows of teeth in said drive gear.

6. The apparatus of claim 2 wherein said boggy rollers are vertically adjustable.

7. An improved drive for a tiltable rotating mixing drum for mixing concrete batch materials or the like comprising:

a rotatable mixing drum comprising a relatively flat rear conical charging zone having a central opening for receiving materials to be mixed from a charging chute, a front conical zone having a central discharge opening therein for discharging mixed materials and a generally cylindrical central zone disposed between said front and said rear conical zones;

support means for supporting said mixing drum for rotation about its longitudinal axis; and drum drive means for causing and controlling the rotation of the drum about its longitudinal axis, said drum drive means further comprising a dual-tooth ring drive gear fixed to said drum and circumscribing said front conical zone having a pair of spaced parallel rows of teeth wherein the teeth of said two spaced rows are offset from each other and wherein said ring gear is adapted to be addressed by at least one pair of drive gears attached to the shaft of a proximately mounted electric motor.

8. The apparatus of claim 7 wherein said spaced parallel rows of teeth in said ring gear are off-set by an amount approximately equal to one-half of the distance of the gear pitch.

9. The apparatus of claim 7 wherein said drum drive means further comprises a pair of electric motors flanking said drum, each of said motors further configurated for rotating a pair of drive gears each of which is adapted to engage one of the two rows of teeth in said ring gear.

10. The apparatus of claim 9 wherein said spaced parallel rows of teeth in said ring gear are off-set by an amount approximately equal to one-half of the distance of the gear pitch.

11. An improved drive for a tiltable rotating mixing drum for mixing concrete batch materials or the like comprising:

a rotatable mixing drum comprising a relatively flat rear conical charging zone having a central opening for receiving materials to be mixed from a charging chute, a front conical zone having a central discharge opening therein for discharging mixed materials and a generally cylindrical central zone disposed between said front and said rear conical zones;

support means for supporting said mixing drum for rotation about its longitudinal axis, said drum support means further comprising a pair of boggy rollers disposed beneath the generally cylindrical central zone of said mixinq drum wherein each of said boggy rollers comprises a pair of rollers suitably journalled in rotatable fashion, mounted on a support means to thereby distribute the weight of said drum, said drum further being provided with a circumferential race in which said boggy rollers are adapted to ride during the rotation of said drum;

drum tilting means for causing said drum to pivot from the horizontal mixing position to a discharge position, said tilting means further comprising rotating torque tube support means providing the pivot axis for the drum during the pivoting function, and tilt actuating means for tilting said drum; and drum drive means for causing and controlling the rotation of the drum about its longitudinal axis, said drum drive means further comprising a dual-tooth ring gear fixed to said drum and circumscribing said front conical zone having a pair of spaced parallel rows of teeth wherein the teeth of said two spaced rows are offset from each other and wherein said ring gear is adapted to be addressed by at least one pair of drive gears attached to the shaft of a proximately mounted electric motor.

* * * * *